US006003673A

United States Patent [19]

Vieu

[11] Patent Number: 6,003,673

[45] Date of Patent: Dec. 21, 1999

[54] PACKAGING UNIT FOR A LIQUID TO SEMI-LIQUID PRODUCT

[75] Inventor: Valerie Vieu, Paris, France

[73] Assignee: L'Oreal, Paris, France

[21] Appl. No.: 09/004,328

[22] Filed: Jan. 8, 1998

[30] Foreign Application Priority Data

Jan. 24, 1997 [FR] France ..... 97-00792

[51] Int. Cl.[6] ..... B65D 69/00

[52] U.S. Cl. ..... 206/581; 206/219; 206/564; 206/1.8; 220/359.2

[58] Field of Search ..... 206/219, 222, 206/562, 564, 561, 1.8, 568, 229, 557; 220/570, 574, 575, 506, 524, 359.1, 359.2, 209; 229/125.35; 132/294; D9/341, 347

[56] References Cited

U.S. PATENT DOCUMENTS

| | | | |
|---|---|---|---|
| 2,745,752 | 5/1956 | Peters . | |
| 4,301,926 | 11/1981 | Chung . | |
| 4,823,985 | 4/1989 | Grollier et al. | 222/1 |
| 4,844,251 | 7/1989 | Gueret | 206/222 |
| 4,852,742 | 8/1989 | Scuorzo | 206/568 |
| 4,867,331 | 9/1989 | Task | 220/23.8 |
| 5,007,231 | 4/1991 | Ingemann | 53/412 |
| 5,353,985 | 10/1994 | Nageli et al. | 229/123.1 |
| 5,671,846 | 9/1997 | Frank | 206/541 |
| 5,775,507 | 7/1998 | Wood | 206/581 |

FOREIGN PATENT DOCUMENTS

| | | |
|---|---|---|
| 498 760 | 8/1992 | European Pat. Off. . |
| 2 451 322 | 10/1980 | France . |
| 1 337 809 | 11/1973 | United Kingdom . |
| WO 94 27868 | 12/1994 | WIPO . |

*Primary Examiner*—Paul T. Sewell
*Assistant Examiner*—Nhan T. Lam
*Attorney, Agent, or Firm*—Oblon, Spivak, McClelland, Maier & Neustadt, P.C.

[57] ABSTRACT

A packaging unit includes a body delimited by a peripheral edge, and defining inside the peripheral edge at least one hollow compartment containing at least one liquid or semi-liquid product, and having an opening. A removable element is provided for obturating the opening in a leakproof manner. A groove forming a gutter is arranged substantially all around the opening of at least one of the compartments. The gutter is capable of receiving a quantity of the product which can escape from the compartment during its opening or during the manipulation of the packaging unit after it has been opened.

23 Claims, 2 Drawing Sheets

PACKAGING UNIT FOR A LIQUID TO SEMI-LIQUID PRODUCT

BACKGROUND OF THE INVENTION

1. Field of the Invention

The invention concerns a packaging unit for a liquid or semiliquid product, preferably one capable of flowing under gravity. The invention is particularly suitable for readily oxidizable products of the type used in the field of hair care, such as reducing agents or coloring products.

2. Description of the Related Art

Such products are typically packaged in thermoplastic boat-shaped receptacles, having one or several compartments containing the product. The compartments are obturated in a leakproof manner by a removable cover which is generally heat sealed. Because of the highly oxidizable nature of certain products, such as those used in the field of hair care, it is necessary to fill the compartment (or compartments) to the top so that there is substantially no space between the free surface of the product and the cover. One of the problems associated with such packaging units relates to the fact that when tearing off the cover to allow access to the product, a portion of the product escapes from the compartment which, apart from the wastage of the product, produces stains, in particular on the hands of the user. Such a packaging unit is described for example in European Patent No. 206 583. The packaging unit there described takes the form of a compartmentalized container in which each compartment is closed by an individual sealing foil.

French Patent No. 2 451 322 describes a boat-shaped food receptacle with a rolled edge, having several compartments closed by a single stretched foil fixed to the rolled edge and forming a cover. The separating partitions between two contiguous compartments progressively rise from one edge in an arc in order to increase the tension of the foil forming the cover. A groove-shaped fillet is disposed in the zones between two contiguous compartments so as to retain the product particles which pass under the cover, in particular during transport, thus forming a leakproof seal between two contiguous compartments once they have been filled. Because of the localized disposition of the fillet or fillets (which is limited to the zones separating the edges common to two contiguous compartments), this arrangement does not resolve the problem mentioned above to the extent that the spattering of the product is not limited to these zones between two contiguous compartments. Moreover, the fillet is not separated from the product inside the compartments, so the groove can be completely filled during transport of the packaging unit, which renders it ineffectual when the tensioned foil is opened. In fact, once filled, the groove can no longer recover in any substantial way the product which may escape when the foil forming the cover is torn away. Moreover, after opening, the product contained in the groove situated between two contiguous compartments remains there, which poses problems when the consumer wishes to recover it. In practice, the product is "lost."

French Patent No. 2 447 322 describes a boat-shaped receptacle for food products, having several compartments covered by a single film. To increase the rigidity of the unit, a stamped recess is made in each of the corners of the receptacle. As in the preceding document, in the closed position of the receptacle, the recesses are not separated from the product (or products) contained in the various compartments.

German Patent No. 3 843 861 describes a thermoformed container fitted with a spout delimited by two hollows situated on either side of the spout, and whose presence only seems justified by the constraints of making the spout by thermoforming.

U.S. Pat. No. 4,863,036 describes a tub for a small dose of cream or milk, on the edge of which there has been provided a small raised tube situated above the filling level and communicating with the container. The combination in two stages of this small tube and an opening of a heat-sealed cover mainly allows the easy dispensing of the product via a small opening. Such a device is particularly unsuitable for the packaging of hair care products such as those mentioned above.

WO-94/27868 and U.S. Pat. No. 2,745,752 describe packaging units of the boat-shaped type with one or several compartments, used for the packaging of meat, butter or other food products of the same type. According to some embodiments, the compartment or compartments are surrounded by a channel whose function is to allow the cover to be cut all around the receptacle when a blade is inserted in the channel at the time of cutting the cover. The teachings of these documents do not resolve the problem of collecting the product which can escape from the compartments, either at the time of their opening or during the manipulation of the packaging unit after opening. Because of the nature of the packaged products, the above problem does not arise. Moreover, to permit the cutting described in these documents, a groove only slightly wider than the width of the blade and of an adequate depth is sufficient.

SUMMARY OF THE INVENTION

One of the objects of the invention is to provide a packaging unit for a liquid or semi-liquid product without the above drawbacks.

It is another object of the invention to provide a packaging unit fitted with a recovery device, making it possible to receive substantially all of the product which could escape from the packaging when it is opened or manipulated after having been opened, while avoiding the stains which could result therefrom.

Yet another object of the invention is to allow the product thus collected to be used, by draining the product towards a recovery zone.

Yet another object of the invention is to provide a packaging unit for a product to be applied by an applicator, and having means for precisely dosing the product on the applicator.

Yet another object of the invention is to provide a packaging unit whose quantity of the product used can be adjusted at will according to the user's requirements.

In accordance with an aspect of the invention, these and other objects are attained by a packaging unit comprising a body delimited by a peripheral edge, and defining inside the peripheral edge at least one hollow compartment containing at least one liquid or semi-liquid product, and having an opening, removable means for obturating the opening in a leakproof manner, and a groove forming a gutter arranged substantially all around the opening of at least one of the compartments. The groove is capable of receiving and containing substantially all the product which can escape from the compartment during its opening or during the manipulation of the packaging unit after it has been opened.

Advantageously, the groove has a bottom inclined towards a zone of greater depth, so as to allow the product drained by the groove to be collected in the zone.

The packaging unit may comprise a plurality of contiguous compartments arranged in pairs, the groove forming a gutter continuously extending substantially all around the compartments and having at least one portion common to two contiguous compartments. Thus, all the product recovered from the time of the opening of the packaging unit can be collected towards the same zone, where it can be used for the same purpose as the rest of the product.

Preferably the removable means, intended to obturate the opening associated with each one of the compartments in a leakproof manner, is disposed so as to separate the compartment (or compartments) in a leakproof manner from the groove forming a gutter. Thus, the recovery capacity of the product escaping from the opening is increased.

Advantageously, each of the compartments is surrounded by a portion with a substantially flat surface, separating the compartment (or compartments) from the groove forming the gutter, the removable means being joined to the said body by a joint line all along the portion with a substantially flat surface. The joint line can be obtained by bonding, thermosealing or welding.

The removable means may be formed by a tear-off foil capable of covering the opening of at least two contiguous compartments, the foil having a prescored line so as to allow each of the contiguous compartments to be opened separately. This foil makes it possible to obtain a larger surface for the decoration or labeling of the product, while permitting a partial use of the product contained in the packaging unit. Alternatively, the removable means are formed by a tear-off foil individually associated with each compartment. The removable means may be formed by a thermoplastic material or aluminum.

The body may be formed by a thermoplastic material chosen from polyvinyl chlorides, polypropylenes, polyethylenes, polystyrenes, or a combination of materials of the type of polypropylene/ethylene-vinyl alcohol/(EVOH)/polypropylene, polyethylene/polyethylene terephthalate, or polystyrene/EVOH/polyethylene. It can be made by thermoforming or injection molding for thin walls.

When the product is intended to be applied by a brush-type application device, the zone with the greater depth may have means which make it possible to wipe the application element so as to dose the product on the application element. Advantageously, such means are constituted by a substantially straight edge of the zone with the greater depth. Alternatively, the zone with the greater depth is used as a mixing zone in the case of a packaging unit with twin compartments. The inclined bottom of the groove may form a slope of from 1° to 10°, and preferably from 1° to 5°. The zone with the greater depth may have a substantially level bottom or an inclined bottom whose slope is from 1° to 30°, and preferably from 5° to 20°. A finger stall-type grip may be provided to facilitate the gripping of the packaging unit by a user.

By way of example, the product may be a hair care product of the reducing agent type for a perm. Alternatively, the packaging unit contains two different products in two separate compartments, thus permitting combinations of the type of an acid solution (thioglycolic acid for example)/a lotion for a perm, a colorant/oxidant for hair coloring, or a colorant/colorant in order to personalize a hair coloration.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
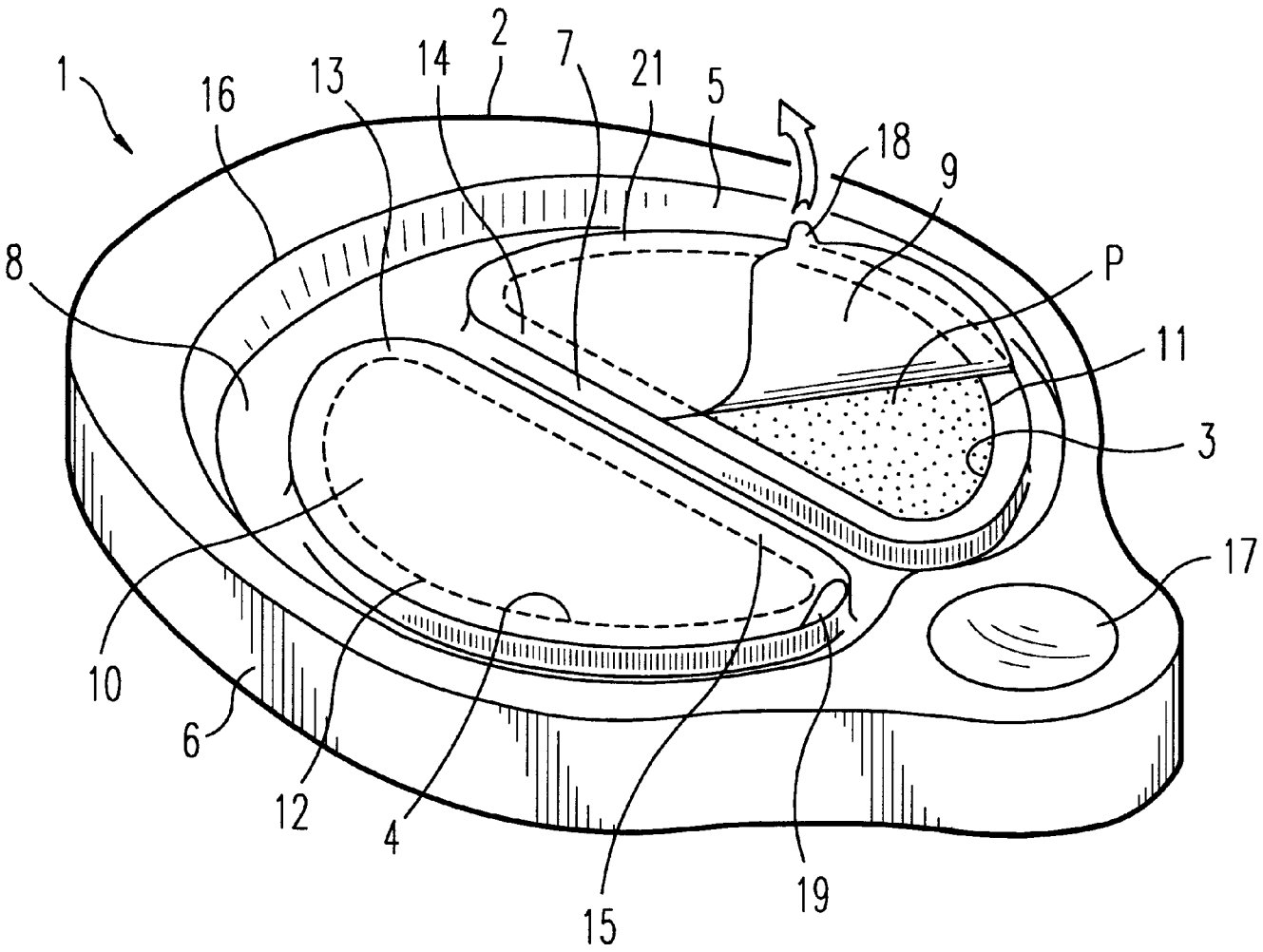
FIG. 1 shows a view in perspective of a first embodiment of the packaging unit in accordance with the invention.

The packagings unit 1 shown in FIG. 1 comprises a body 2, preferably a thermoplastic body, delimited by a peripheral edge 6 and obtained by thermoforming, or by thin wall injection molding, of materials compatible with the product to be packaged. Typically used materials are polyvinyl chlorides, polypropylenes, polyethylenes, polystyrenes or a combination of materials of the type of polypropylene/ethylene-vinyl alcohol (EVOH)/polypropylene, polyethylene/polyethylene terephthalate or polystyrene/EVOH/polyethylene. In the embodiment illustrated, the peripheral edge 6 forms a lateral skirt imparting greater stability to the packaging unit 1 when the unit is placed on a flat support. The body 2 defines two hollow compartments 3 and 4 of a partly ovoid or elliptical shape, each one being intended to be filled with a product P. Each of the compartments 3 and 4 has an opening 11, 12 opening onto the upper surface of the body 2 and substantially coinciding with the cross-section of the compartments 3 and 4. In accordance with a variant, each of the compartments 3 and 4 contains a different product.

Each of the compartments 3 and 4 is closed individually by a heat-sealed cover 9, 10 of aluminum, optionally coated with an adhesive of the heat-bonding varnish type, of a plastic, or of any other material. The covers 9 and 10 are fixed by heat sealing, bonding, welding or any other appropriate technique. The fixing is effected along a fixing zone 13, 21 around each one of the compartments 3 and 4 and constituted by a substantially flat surface portion situated around each of the openings 11 and 12. Each of the covers 9 and 10 has a tear-off tongue 18, 19 so as to facilitate the removal of the cover. Alternatively, a single cover may cover the two compartments 3 and 4, means being optionally provided to allow the separate opening of each of the compartments 3 and 4. By way of example, a pre-scored line may be made in the cover between the two contiguous flat surface portions 14 and 15 of the two compartments 3 and 4. This makes it possible to provide a larger surface for the decoration or labeling of the product P.

In this configuration, although covered at least partly by the heat-sealed foil (in particular at the portion between the compartments 3 and 4), a groove forming a gutter 5 all around each of the compartments 3 and 4 is separated from the contents of the compartments 3 and 4 by the seal obtained all around the compartments 3 and 4 on the flat surfaces 14 and 15. The gutter 5 has a portion 7 common to the two compartments 3 and 4.

The function of the groove forming the gutter 5 is to recover substantially all the product P which could escape from the compartments 3 and 4 when the cover 9 and 10 are removed, or during the manipulation of the packaging unit 1 after the compartment 3 and 4 or compartments have been opened. For this purpose, it must delimit a sufficient volume and have a configuration, in particular a width, capable of receiving and containing all of the product P escaping from the compartments 3 and 4 irrespective of the viscosity of the products. The groove forming the gutter 5 is advantageously situated between the peripheral edge 6 and the flat surfaces 14 and 15 on which the seal of the covers 9 and 10 is made, so as to be separated from the contents of the compartments 3 and 4 when the compartments 3 and 4 are provided with the cover 9 and 10. Thus the groove forming the gutter 5 cannot fill up during transport of the packaging unit 1, which allows it to fulfil its function during the removal of the cover 9 and 10 from the compartments 3 and 4.

Figure 2A:
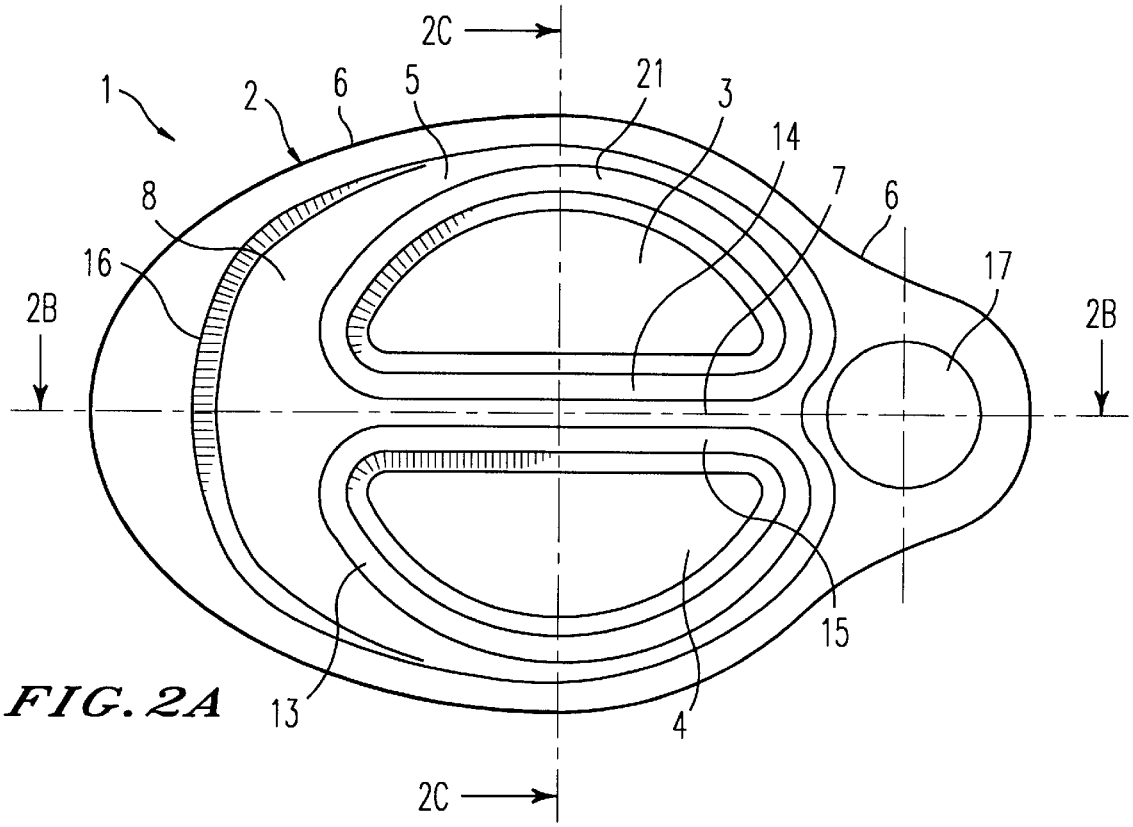
FIGS. 2A–2C show different views of another embodiment of a packaging unit according to the invention.
Figure 2B:
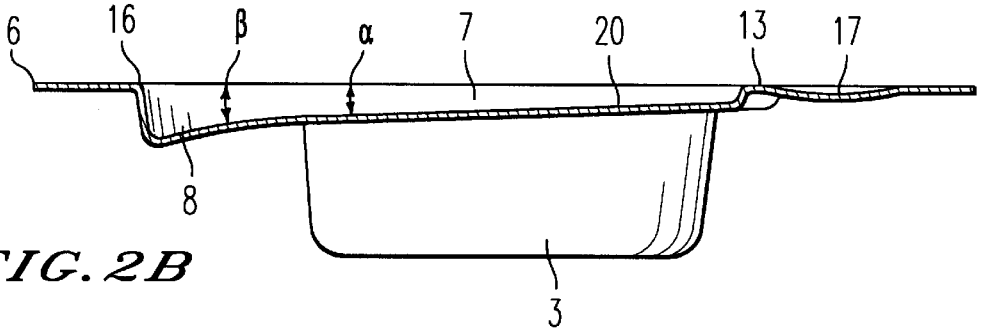
Figure 2C:
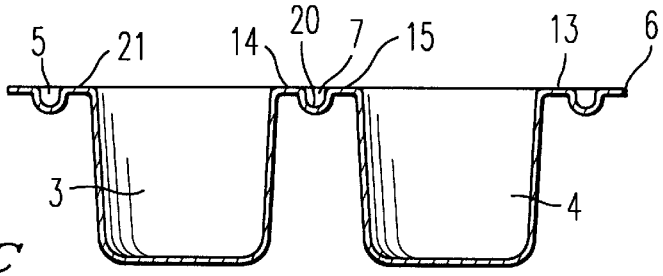

As will be see more clearly with reference to FIGS. 2A to 2C, the groove preferably has a bottom inclined towards a zone 8 of greater depth, so as to drain towards the zone 8 the product which has collected in the gutter 5 during the removal of the cover from the compartments 3 and 4. The zone 8 of greater depth defines a substantially straight edge 16, advantageously used for wiping a brush-type applicator element. In practice, the edge 16 may form an angle of the order of 10° relative to the vertical.

By way of an accessory, the zone 8 with the greater depth is used as a zone for mixing. This feature is particularly suitable in the case of a packaging unit 1 having a different product in each of the compartments 3 and 4. By way of example, in the case of hair coloring products, a first compartment 3 will comprise a first shade, and the second compartment 4 will comprise a second shade. The user takes up a dose of the first shade by a brush or any other appropriate means and deposits it in the zone 8 of greater depth. She then takes up a dose of the second shade and also deposits in the zone 8 of greater depth, where she can undertake mixing.

The end of the body 2 opposite the wiper edge 16 advantageously has a zone 17 forming a slight depression of a circular shape, suitable for facilitating the gripping of the packaging unit 1.

For using the packaging unit 1 of FIG. 1, for example for the application of a hair product P by means of a brush (not shown), the user removes the cover 9 or 10 from one and/or the other of the compartments 3, 4, depending on the size of the surface to be treated (short hair or long hair). The product P which escapes from the compartment 3 and 4 or compartments during the removal of the cover 9 or 10 by passing over the flat surface portions 14 and 15, is recovered in the gutter 5 and is drained towards the zone 8. The user takes up the product P from one and/or the other of the compartments 3 and 4 by the brush, and applies it to the surface to be treated, after having first applied the brush to the edge 16 of the wiper, so as to correctly measure out the dose taken up. The product P collected in the zone 8 is also taken up by the brush and can thus be used for the same purpose as the rest of the product. Thus, substantially all the product P can be used up. If the contents of only one of the compartments 3 and 4 is used up during one operation, the packaging unit 1 can be put under water tap to be cleaned.

FIGS. 2A to 2C illustrate different views of an embodiment slightly different from that of FIG. 1. According to this second embodiment, the packaging unit 1 has no lateral skirt at its peripheral edge 6. This edge 6 facilitates the grasping of the packaging unit 1. The other parts of the packaging unit are identical with those of the device of FIG. 1 and therefore do not require any additional description. However, as they are more clearly shown in the cross-sectional views of FIGS. 2B and 2C, the compartments 3 and 4 have the same shape, and have a flat bottom allowing the packaging unit 1 to be placed on a flat surface. A groove forming the gutter 5 is substantially U-shaped. The slope α is formed by a bottom 20 of the groove 5 between the compartments 3 and 4 and is from 1° to 10°, preferably from 1° to 5°. The bottom 20 of the zone 8 with the greater depth can be substantially level or can be inclined so as to form an angle β of from 1° to 30°, and preferably from 5° to 20°. The slope α and the angle β relating to the inclination of the bottom 20 of the gutter 5 or of the zone 8 of greater depth depend, of course to a large extent on the viscosity of the product P (or products).

According to another alternative, the groove width is sufficient to allow a brush-type applicator to be introduced into it. This arrangement allows the product P to be directly taken up in the gutter 5 by the brush, or to accelerate the draining of the product P in the gutter 5 towards the zone 8 of greater depth. This modification is particularly worthwhile for very viscous products with a slow rate of flow.

A packaging unit 1 was made as described above with reference to FIGS. 2A to 2C. The product P was a reducing agent for perms. The packaging unit 1 comprised two compartments 3 and 4 individually obturated by heat-sealed covers 9 and 10 of aluminum. The unit 1 was obtained by thermoforming a PP/EVOH/PP laminate. The compartments 3 and 4 had the shape of a truncated ellipse in the region of an edge 7 common to the two compartments 3 and 4.

| | |
|---|---|
| Total length of the packaging unit 1 | 174 mm |
| Total width of the packaging unit 1 | 109 mm |
| Maximum width of the compartments 3 and 4 | 32 mm |
| Maximum length of the compartments 3 and 4 | 80 mm |
| Depth of the compartments | 32 mm |
| Angle of slope α | 2° |
| Angle of inclination β | 12° |
| Width of the gritter 5 opposite the compartments 3 and 4 | 5 mm |
| Width of the flat surfaces 14 and 15 for the sealing of the covers 9 and 10 | 5 mm |
| Height of the wiper edge 16 | 10 mm |

Obviously, numerous modifications and variations of the present invention are possible in light of the above teachings. It is therefore to be understood that the invention may be practiced otherwise than as specifically described herein.

I claim:

1. A packaging unit, comprising:

a body delimited by a peripheral edge and defining inside the peripheral edge at least one hollow compartment containing at least one of a liquid and a semi-liquid product, said at least one compartment having an opening;

a groove, forming a gutter all around the opening, for receiving and containing all spilled product which could possibly escape from the compartment; and a removable cover for sealingly obturating the opening of said at least one compartment, said removable cover extending not as far as the groove so that the groove always remains open for receiving the spilled product.

2. A packaging unit according to claim 1, wherein the groove has a bottom inclined downwardly toward a zone of greater depth, so that the spilled product in said groove may flow by gravity to be collected in said zone.

3. A packaging unit according to claim 2, wherein the groove has an edge for wiping excess product into the zone of greater depth so as to dose the product thereon.

4. A packaging unit according to claim 3, wherein the edge for wiping is a substantially straight edge of the zone of greater depth.

5. A packaging unit according to claim 2, wherein the inclined bottom of the groove forms a slope (α) of from 1° to 10°.

6. A packaging unit according to claim 2, wherein the inclined bottom of the groove forms a slope (α) of from 1° to 5°.

7. A packaging unit according to claim 2, wherein the zone of greater depth has a substantially level bottom.

8. A packaging unit according to claim 2, wherein the zone of greater depth has a bottom inclined along an angle (β) of from 1° to 30°.

9. A packaging unit according to claim 2, wherein the zone of greater depth has a bottom inclined along an angle (β) of from 5° to 20°.

10. A packaging unit according to claim 1, wherein said at least one compartment comprises a pair of contiguous compartments, said groove forming a gutter continuously extending substantially all around the compartments and having at least one portion common to the contiguous compartments.

11. A packaging unit according to claim 10, wherein the removable cover comprise a pair of tear-off foils capable of covering the openings of the pair of contiguous compartments, each of the foils allowing each one of the contiguous compartments to be opened separately.

12. A packaging unit according to claim 10, wherein said removable cover are formed by a tear-off foil individually associated with each of said compartments.

13. A packaging unit according to claim 1, wherein the removable cover sealingly separates said at least one compartment from the groove.

14. A packaging unit according to claim 13, wherein said at least one compartment is surrounded by a portion with a substantially flat surface for separating the compartment from the groove, said removable cover being joined to the body at a joint line all along the portion with a substantially flat surface.

15. A packaging unit according to claim 13, wherein the joint line is one of a bonded, heat sealed and welded joint line.

16. A packaging unit according to claim 1, wherein said removable cover are formed of one of a thermoplastic material and aluminum.

17. A packaging unit according to claim 1, wherein the body is made of a thermoplastic material chosen from one of polyvinyl chlorides, polypropylenes, polyethylenes, polystyrenes, and a combination of materials of the type polypropylene/ethylene-vinyl alcohol/(EVOH)/polypropylene, polyethylene/polyethylene terephthalate, and polystyrene/EVOH/polyethylene.

18. A packaging unit according to claim 17, wherein the thermoplastic body is made by one of thermoforming and thin wall injection molding.

19. A packaging unit according to claim 1, including a depressed zone for facilitating the gripping of the packaging unit by a user.

20. A packaging unit according to claims 1, wherein the product is a reducing hair care product for a perm.

21. A packaging unit according to claim 1, wherein said at least one compartment comprises two compartments, each one of the compartments containing a different hair care product, a first product being one of a first colorant and an acid solution, and a second product being one of a lotion for a perm, a second colorant and an oxidizing solution.

22. A packaging unit comprising:

a body delimited by a peripheral edge and defining inside the peripheral edge at least one hollow compartment containing at least one of a liquid and a semi-liquid product, said at least one compartment having an opening;

a groove, forming a gutter substantially all around the opening, for receiving and containing spilled product which escapes from the compartment; and a removable member for sealingly obturating the opening of said at least one compartment, said groove being capable of receiving and collecting substantially all the product that may escape, at least at the opening of said removable member.

23. A packaging unit comprising:

a body delimited by a peripheral edge and defining inside the peripheral edge at least one hollow compartment containing at least one of a liquid and a semi-liquid product, said at least one compartment having an opening;

a groove, forming a gutter substantially all around the opening, for receiving and containing spilled product which escapes from the compartment; and a removable member for sealingly obturating the opening of said at least one compartment, said groove being of varying depth so that the product received in said groove can be collected in a zone of greater depth.

* * * * *

UNITED STATES PATENT AND TRADEMARK OFFICE

CERTIFICATE OF CORRECTION

PATENT NO. : 6,003,673

DATED : December 21, 1999

INVENTOR(S): Valerie Vieu

It is certified that an error appears in the above-identified patent and that said Letters Patent is hereby corrected as shown below:

Col. 3, line 16, delete "said";

Col. 5, line 55, after "unit" (second occurrence), insert --1--;

Col. 5, line 61, change "A" to --The--; and

Col. 5, line 62, change "The" to --A--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*